US006761416B2

(12) United States Patent
Moeny

(10) Patent No.: US 6,761,416 B2
(45) Date of Patent: Jul. 13, 2004

(54) METHOD AND APPARATUS FOR A PLASMA-HYDRAULIC CONTINUOUS EXCAVATION SYSTEM

(75) Inventor: William M. Moeny, Albuquerque, NM (US)

(73) Assignee: Placer Dome Technical Services Limited (CA)

( * ) Notice: Subject to any disclaimer, the term of this patent is extended or adjusted under 35 U.S.C. 154(b) by 44 days.

(21) Appl. No.: 10/336,221

(22) Filed: Jan. 3, 2003

(65) Prior Publication Data

US 2003/0137182 A1 Jul. 24, 2003

Related U.S. Application Data

(60) Provisional application No. 60/345,232, filed on Jan. 3, 2002.

(51) Int. Cl.[7] ..... E21C 37/18
(52) U.S. Cl. ..... 299/14; 299/16; 175/16
(58) Field of Search ..... 299/14, 16; 175/16

(56) References Cited

U.S. PATENT DOCUMENTS

| | | | | |
|---|---|---|---|---|
| 3,004,137 A | | 10/1961 | Karlovitz | 219/75 |
| 3,245,721 A | | 4/1966 | Margiloff | 299/14 |
| 3,788,703 A | | 1/1974 | Thorpe | 299/14 |
| 3,840,270 A | | 10/1974 | Allgood | 299/14 |
| 3,847,584 A | | 11/1974 | Houser et al. | 65/40 |
| 4,375,594 A | | 3/1983 | Ewanizky, Jr. | 307/110 |
| 4,479,680 A | * | 10/1984 | Wesley et al. | 299/14 |
| 4,541,848 A | | 9/1985 | Masuda | 55/139 |
| 4,653,697 A | * | 3/1987 | Codina | 241/1 |
| 4,741,405 A | | 5/1988 | Moeny et al. | 175/16 |
| 4,957,606 A | | 9/1990 | Juvan | 204/164 |
| 5,228,011 A | | 7/1993 | Owen | 367/147 |
| 5,398,217 A | | 3/1995 | Cannelli et al. | 367/147 |
| 5,432,756 A | | 7/1995 | Bryden | 367/139 |
| 5,896,938 A | | 4/1999 | Moeny et al. | 175/1 |
| 6,058,029 A | | 5/2000 | Itow et al. | 363/59 |
| 6,164,388 A | | 12/2000 | Martunovich et al. | 175/1 |
| 6,215,734 B1 | | 4/2001 | Moeny et al. | 367/147 |

FOREIGN PATENT DOCUMENTS

| | | | | |
|---|---|---|---|---|
| EP | WO 98/06234 | | 2/1998 | H04R/23/00 |
| EP | 0921270 A1 | * | 9/1999 | |
| GB | 2 120 579 | | 12/1983 | |
| JP | 2001040979 A | * | 2/2001 | E21C/37/18 |
| SU | 1701885 A1 | * | 12/1991 | E21B/7/15 |

* cited by examiner

*Primary Examiner*—John Kreck
(74) *Attorney, Agent, or Firm*—Sheridan Ross P.C.

(57) ABSTRACT

A plasma-hydraulic excavation system suitable for use in connection with mining operations is provided. According to the system, one or more groups of plasma-hydraulic projectors that include a reflector and a pair of electrodes are used to break an area of rock. The projectors include a connection box within which high voltage connections between the electrodes of the projector and a power supply cable may be made. Groups of projectors and supporting componentry may be housed within a common frame, to form an excavation module. Electrode insulators interconnected to the projector reflector in compression are also disclosed. A trigger circuit providing a voltage transformer for each projector in a group of projectors is utilized in connection with a series connected current source circuit to provide for the ignition of the projectors. According to an embodiment of the invention, multiple groups of projectors may be operated using a single current control switch.

24 Claims, 9 Drawing Sheets

SIDE VIEW

METHOD AND APPARATUS FOR A PLASMA-HYDRAULIC CONTINUOUS EXCAVATION SYSTEM

CROSS REFERENCE TO RELATED APPLICATIONS

Priority is claimed from U.S. Provisional Patent Application No. 60/345,232, filed Jan. 3, 2002, entitled "METHOD AND APPARATUS FOR PLASMA-HYDRAULIC CONTINOUS EXCAVATION SYSTEM", the disclosure of which is incorporated herein by reference in its entirety.

FIELD OF THE INVENTION

The present invention relates to plasma-hydraulic excavation systems. In particular, the present invention relates to a plasma-hydraulic excavation system suitable for use in connection with mining operations, quarying and civil applications.

BACKGROUND OF THE INVENTION

Conventional continuous mining techniques utilize mechanical fracturing and crushing as the primary mechanism for pulverizing rock. However, in hard rock applications the cutting edges of tools used in connection with mechanical fracturing and crushing require frequent replacement, and the overall efficiency of such methods is poor. In addition, significant pressure must be exerted against the face of the rock in order to achieve the desired fracturing, or cutting, using mechanical techniques.

In order to improve the speed and efficiency with which rock can be continuously excavated, mechanical techniques have been used in combination with explosives. According to such techniques, holes may be formed in the rock face using mechanical drills. Explosives may then be placed within the holes and ignited, causing the rock to fracture. However, such techniques are particularly dangerous for operators, because they involve the use of explosive materials. In addition, such techniques remain dependent on mechanical drills to form holes into which the explosives may be placed.

Still another approach has used projectors that create plasma-hydraulic (or electro-hydraulic), acoustic, and pressure waves to break rock. In such a system, and with reference to FIG. 1, a high voltage is introduced across electrodes 104 immersed in water or some other liquid 108. When the voltage potential between the electrodes 104 is high enough, and the electric field produced by the electrodes 104 exceeds the breakdown electric field of the liquid 108, a conducting plasma channel 112 forms between the two electrodes 104. In addition, a zone of steam or vapor 116 is formed around the plasma channel 112. This zone of vapor 116 propagates outwardly from the channel 112 at a rate that is a function of the power deposited by the electrical current between the electrodes 104 into the channel 112. Power is conducted from the channel 112 to the vapor 116 by thermal conduction and by thermal radiation. A significant portion of the thermal radiation is trapped in the liquid 108 and produces ablation of the bubble wall 120 surrounding the zone of vapor 116, thus adding additional steam 116.

Using plasma-hydraulic methods, very strong pressure waves 124 can be produced as the bubble wall 120 expands against the surrounding liquid 108. By controlling the resulting shock wave, plasma-hydraulic methods may be used to efficiently fragment and break rock in connection with mining and excavation operations. Additional information related to the use of plasma-hydraulic methods can be found in U.S. Pat. Nos. 4,741,405 to Moeny et al., 5,896,938 to Moeny et al., and 6,215,734 to Moeny et al., the disclosures of which are hereby incorporated by reference herein in their entireties.

Although the use of plasma-hydraulic methods to excavate rock are known, the practical implementation of such methods has remained difficult. In particular, the ignition of a series of plasma-hydraulic projectors to excavate an area of rock is difficult, as the cumulative voltage required to ignite the gaps may become exceedingly high. Furthermore, the connection of high voltage cables to the electrodes is problematic, particularly in a wet, dirty mine environment. Also, the reliable mounting of electrode insulators has been problematic. In addition, it would be desirable to reduce the number of electrical cables required to implement a plasma-hydraulic system. Furthermore, it would be desirable to closely integrate plasma-hydraulic projectors and their associated power supplies to allow for the efficient use of plasma-hydraulic methods of breaking rock in a mine environment.

SUMMARY OF THE INVENTION

The present invention is directed to solving these and other problems and disadvantages of the prior art. Generally, according to the present invention, one or more groups of plasma-hydraulic projectors are used to break an area of rock. In a typical configuration, each projector within a group includes a reflector, two electrodes defining a gap therebetween, and a connection box in which a high voltage connection between at least a first electrode and a power supply cable may be made. Furthermore, a group of projectors may be interconnected to a common frame that also houses power supply components to form an excavation module. For example, power supply capacitors may be located within the frame, in close proximity to the projectors. Additional components that may be provided as part of the excavation module include trigger circuit transformers and a trigger circuit switch used in connection with the ignition of the projectors.

In accordance with an embodiment of the present invention, the connection box associated with each of the projectors is a water tight housing defining an interior space. The connection box is adapted to receive at least a first electrode of the projector and power supply cables. Interconnections between the at least a first electrode and the power supply cables are made within the interior of the connection box. The entry points of the electrode and the power cables into the connection box are sealed. The connection box allows the high voltage connections between the power supply cables and the electrode to be made quickly and easily. In addition, the connection box provides a space in which the interconnection between the electrode and the power supply cables can be made that is protected from water or other liquids used in connection with the plasma-hydraulic excavation system, and from dirt and debris in the mine environment. In accordance with a further embodiment of the present invention, high voltage connections to both hot and ground electrodes associated with a projector are made within a single connection box.

In accordance with another embodiment of the present invention, the projectors feature an electrode insulator that is mounted in compression to the projector assembly. By mounting the insulator in compression, the reliability and useful life of the insulator is increased as compared to a system that places the insulator in tension.

In accordance with still another embodiment of the present invention, a group of projectors are electrically interconnected to one another in series. In addition, the secondary winding of a trigger transformer is interconnected across the gap of each of the projectors. The primary windings of the trigger transformers are interconnected in parallel to a trigger voltage source to form a trigger circuit. When firing, or ignition of the group of projectors is desired, a trigger voltage source switch connecting the primary windings of the transformers to the trigger voltage source is closed at about the same time that a current source switch connecting a current source to the series connected projector gaps is closed. The voltage supplied across each projector gap by the trigger circuit creates a voltage potential across each projector gap that exceeds the breakdown voltage of the liquid in the gap. Accordingly, a microscopic current channel, or streamer, is established between the electrode pair. At about the same time that the current channel is established, the voltage potential from the current source is at or near a maximum. The current channel, or streamer, then conducts the current from the current source, resulting in ignition of the projectors and creating a shock wave that breaks the rock adjacent to the face of the projector.

According to yet another embodiment of the present invention, multiple current source circuits comprising multiple capacitor banks for supplying current to corresponding groups of projectors are operated from a single current source switch using a single pair of control cables. According to such an embodiment each capacitor bank may comprise a vector inversion circuit. Multiple vector inversion circuits may be connected in parallel with a single current source switch to allow their simultaneous operation. In accordance with an embodiment of the present invention, the current source switch comprises a thyratron.

Additional advantages of the present invention will become readily apparent from the following discussion, particularly when taken together with the accompanying drawings.

DETAILED DESCRIPTION

In accordance with the present invention, a plasma-hydraulic continuous excavation system is provided.

Figure 1:
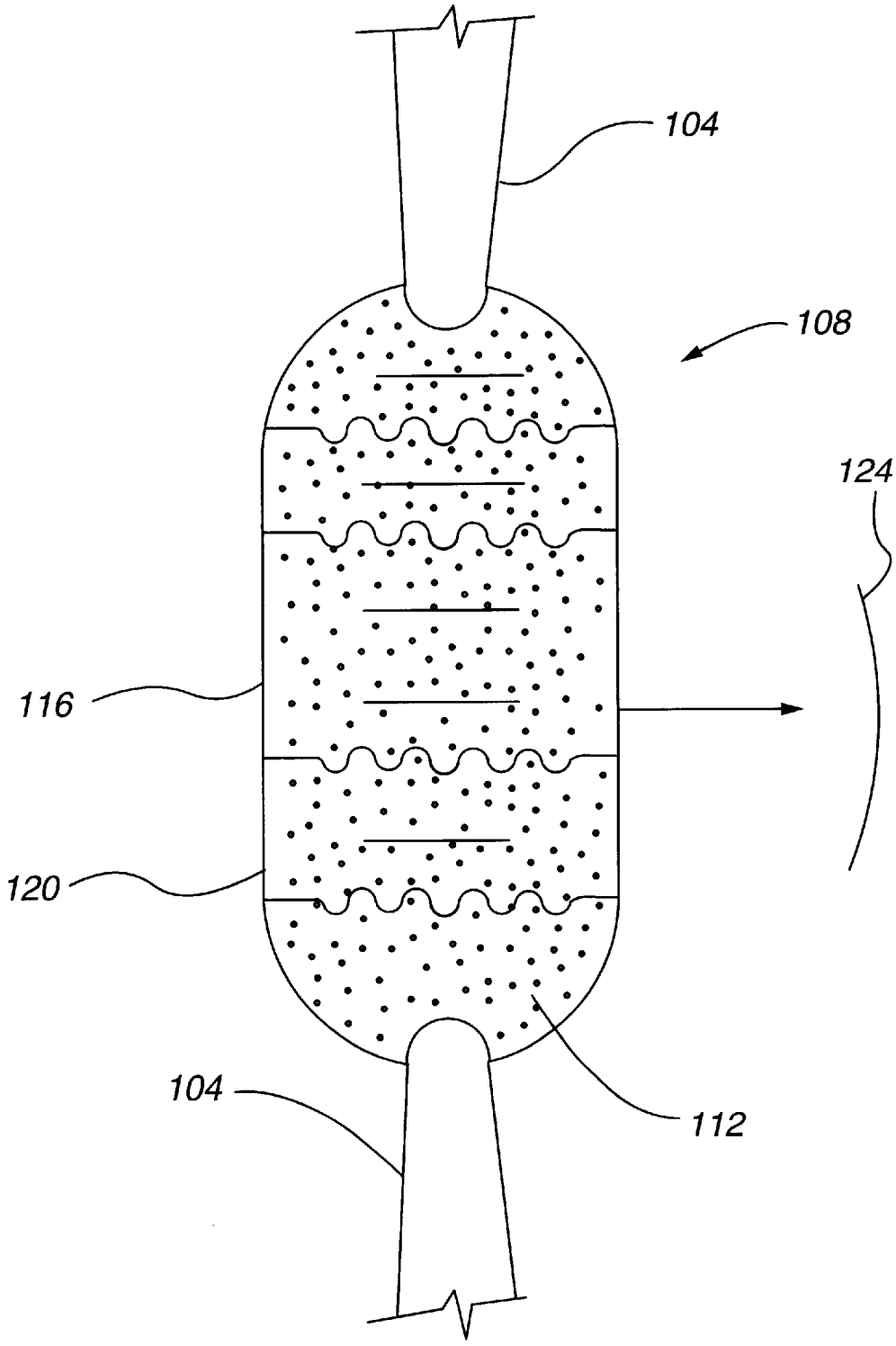
Fig. 1 PRIOR ART
FIG. 1 depicts a plasma-hydraulic process.
Figure 2:
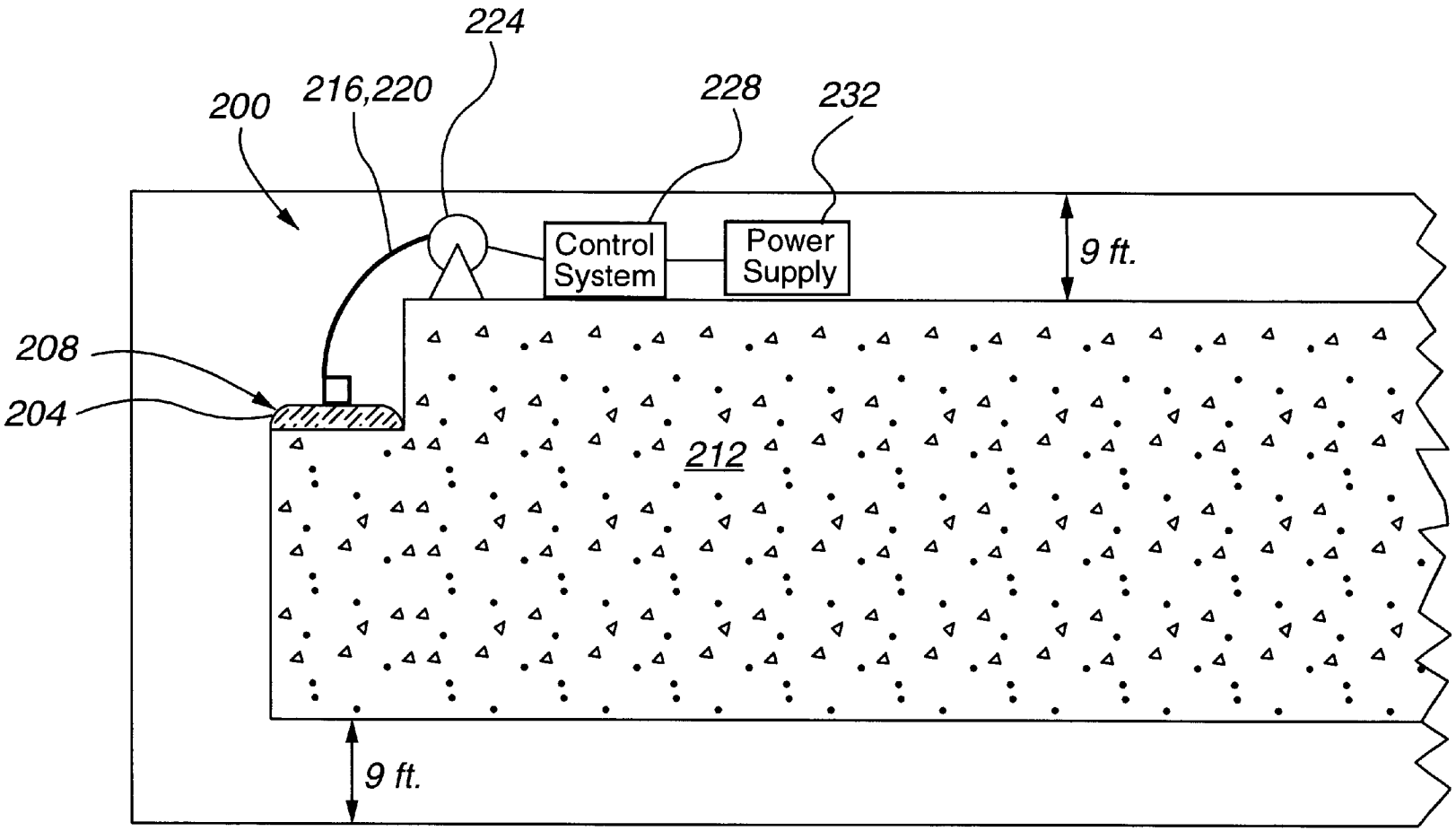
FIG. 2 is a schematic diagram depicting the use of a plasma-hydraulic continuous excavation system in accordance with an embodiment of the present invention in a mine environment.

With reference to FIG. 2, the use of a plasma-hydraulic continuous excavation system 200 in accordance with an embodiment of the present invention in a mine environment is illustrated. In general, the excavation system of the present invention may comprise a group of projectors 204 included as part of a plasma-hydraulic excavation module 208, the face of which is placed against the rock surface or the material 212 being excavated. Power cables 216 provide electrical power to the plasma-hydraulic excavation module 208. A water line 220 supplies water, or other liquids, for providing a shock wave medium. The power cables 216 and water line 220 may be stored on a cable reel 224 that may be positioned separate from the material 212 being excavated. A control module 228 allows an operator to selectively fire the group of projectors 204. In addition, the control module 228 may be operated such that the relative excavation rates of various groups of projectors are controlled to steer the excavation module or modules 208 under control of the control module 228 and/or to accommodate a slant or a change in direction of the material 212 being excavated. A power supply 232 provides the electrical power required to operate the plasma-hydraulic excavation module 208.

In addition to providing a transmission medium for the shock wave produced when the group of projectors 204 is fired, the liquid supplied to the projectors may be used to flush debris away from the surface being excavated. Alternatively, a suction line can be attached to the plasma-hydraulic excavation module 208 to remove the rock fragmented by the system 200, and water, away from the excavation area.

In accordance with an embodiment of the present invention, the group of projectors 204 is ignited, or fired, at a predetermined frequency during a typical excavation process. For example, the group of projectors 204 may be ignited about ten times per second. The system 200 may be understood as being continuous in that the ignition frequency of the group of projectors 204 may be maintained for hours or days until a cut has been completed. In a typical excavation application, the system 200 is capable of producing rock particles that are a few millimeters in size. Hoist cables may be provided for repositioning the plasma-hydraulic excavation module 208 after a cut has been completed. Although FIG. 2 illustrates the plasma-hydraulic excavation module 208 being used in a vertical mode, it should be appreciated that the module 208 may also be used in a horizontal mode or in angled modes.

Figure 3:
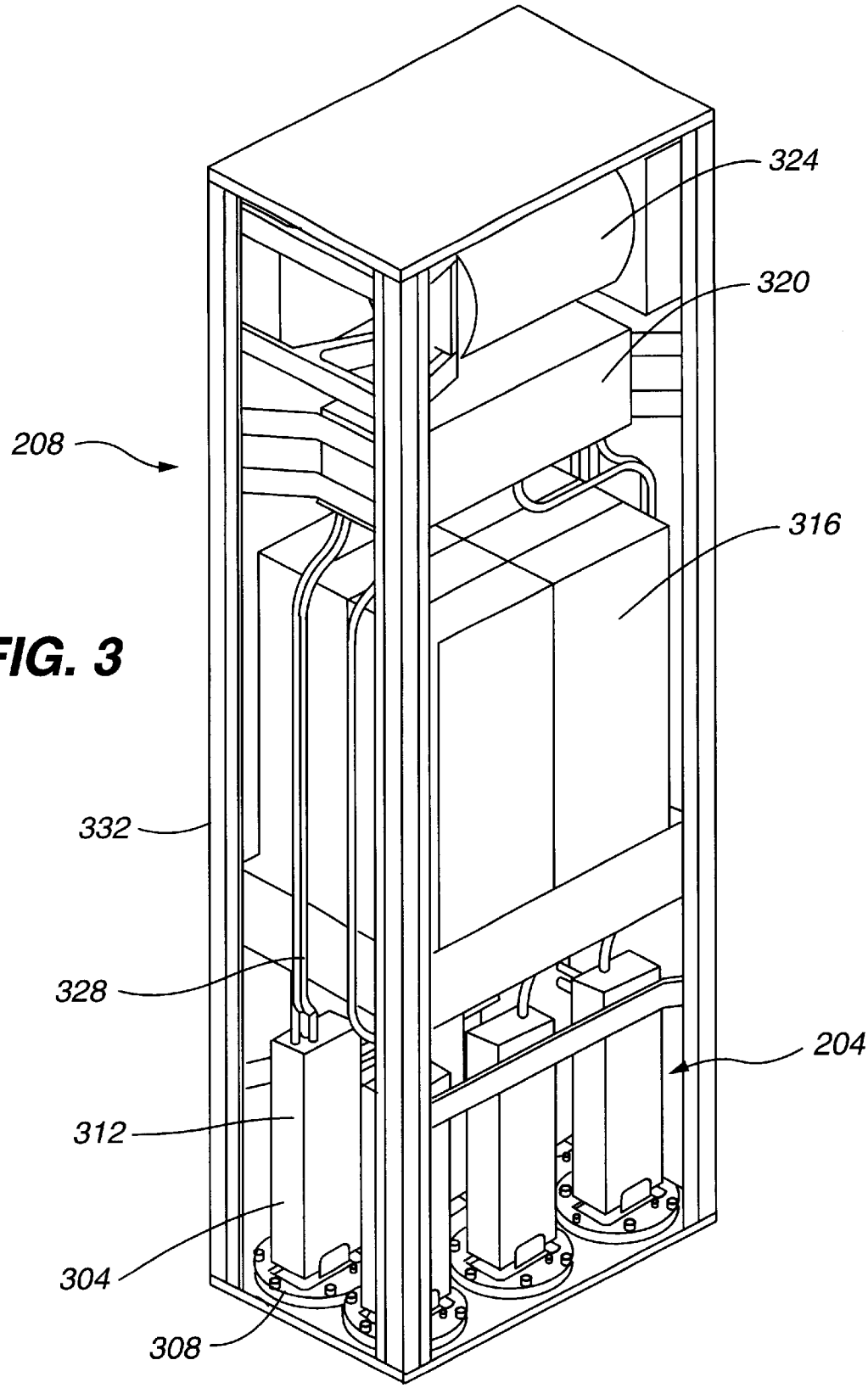
FIG. 3 is a perspective view of a plasma-hydraulic excavation module in accordance with an embodiment of the present invention.

In FIG. 3, a plasma-hydraulic excavation module 208 is illustrated. In general, a group of projectors 204 are arranged at an end of the plasma-hydraulic excavation module 208. As shown in FIG. 3, each projector 304 comprises a reflector 308 and a connector box 312. The projectors 304 are spaced from one another to provide a maximum area of rock breakage, while providing complete breakage of the rock within the area. The exact spacing between projectors 304 will vary depending on the properties of the rock to be excavated.

The plasma-hydraulic excavation module 208 additionally comprises main supply capacitors 316, for supplying electrical current used in connection with the firing of the projectors 304. In addition, the plasma-hydraulic excavation module 208 may comprise trigger circuit transformers 320 and a trigger circuit switch 324, also used in connection with the firing of the projectors 304. Power cables 328 are provided to interconnect the projectors 304 to the main supply capacitors 316 and to the trigger circuit transformers 320. The various components of the plasma-hydraulic excavation module 208 may be mounted to a frame 332.

Figure 4:
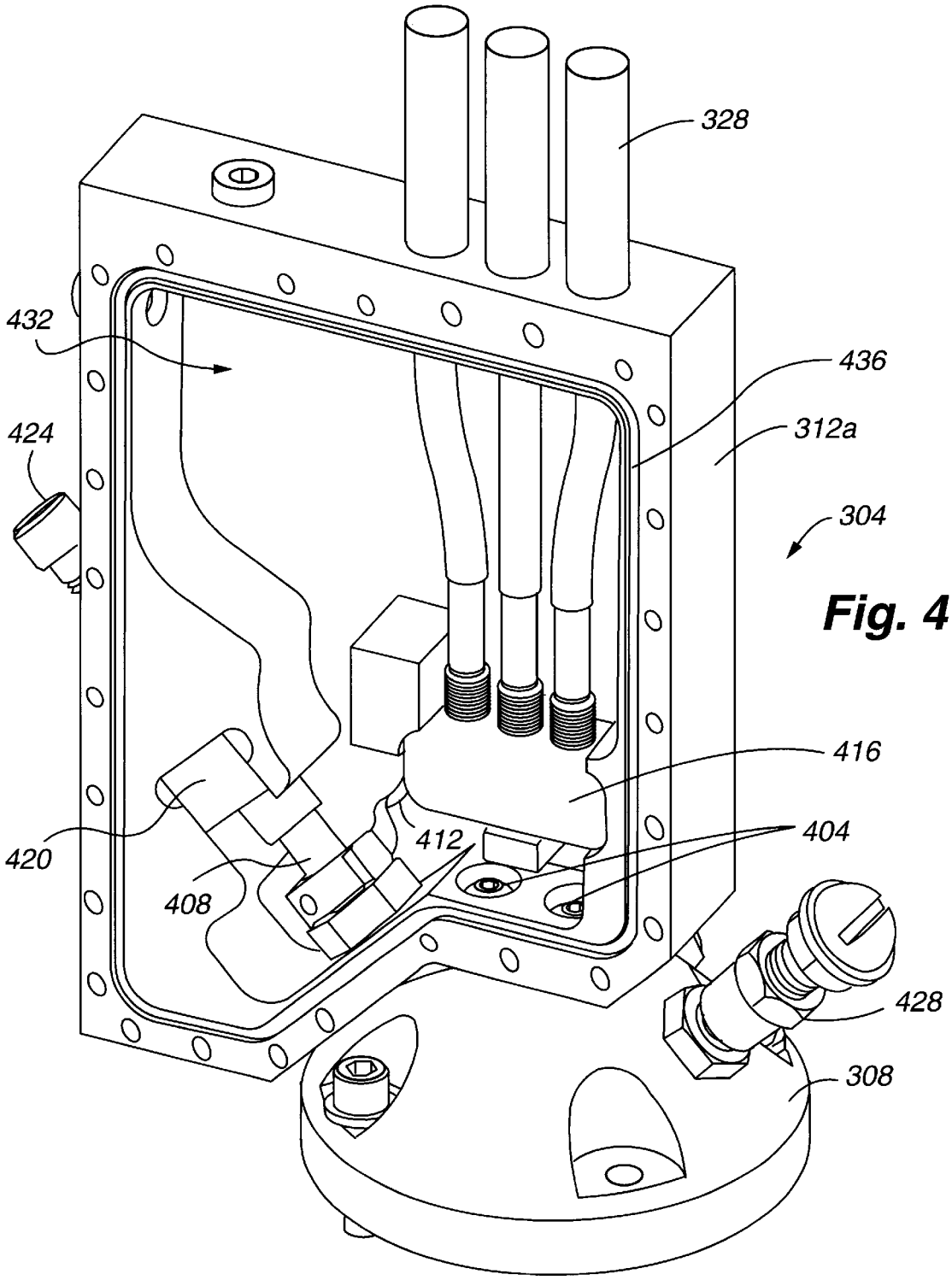
FIG. 4 is a perspective view of a high voltage connection box of a projector, with the cover removed, in accordance with an embodiment of the present invention.

In FIG. 4, a connection box 312*a* of a projector 304 in accordance with an embodiment of the present invention is illustrated with a side cover removed. As shown in FIG. 4, the connection box 312*a* may be interconnected to the reflector 308 by fasteners 404. A first, or hot electrode 408, extends into the interior of the connector box 312*a*. Electrical power is supplied to the first electrode 408 by a conductor 412. A socket block 416 interconnects the conductor 412 to the power cables 328. A cushion or support 420 may be provided to help stabilize the first electrode 408. In addition, the first electrode 408 may have its position controlled by a motor, to allow adjustment of the first electrode 408, such as to compensate for wear. In addition, an access plug 424 may be provided to facilitate replacement of the first electrode 408. A second or ground electrode 428 is positioned on a side of the reflector 308 opposite the first electrode 408. In accordance with an embodiment of the present invention, either or both of the electrodes may be formed from a wear resistant material.

In general, the entry points for the first electrode 408, the power cables 328, and for any other component that passes through the connection box 312*a* are sealed to prevent the entry of liquids and particulates into the interior cavity 432 of the connection box 312. Furthermore, a gasket 436 may be provided to seal the side panel (not shown) to the connection box 312*a*.

The connection box 312*a* may be formed from a dielectric material. According to such an embodiment, various components associated with the connection box 312*a* can be uninsulated. For example, the conductor 412 may comprise a conductive metal strap, and the socket block 416 may comprise a conductive metal block that is machined to receive the power cables 328 and the conductor 412. In addition, a conductive metal sheet may be provided along the exterior of the connection box 312*a* for return current from the ground electrode 428. An end of the conductive metal sheet may be interconnected to return current conductors provided as part of the power cables 328.

In accordance with an embodiment of the present invention, the power cables 328 are of coaxial design. The supply current may be provided by an inner conductor, while the return current may be conducted by an intermediate conductive sheath. An outer sheath may also be included to provide armoring of the respective power cable 328. The outer portion of the cable is designed so that it carries no current during normal operation, and may be connected to ground to provide safety protection for the system 200. Accordingly, the power cables 328 may be of triaxial design.

Figure 5:
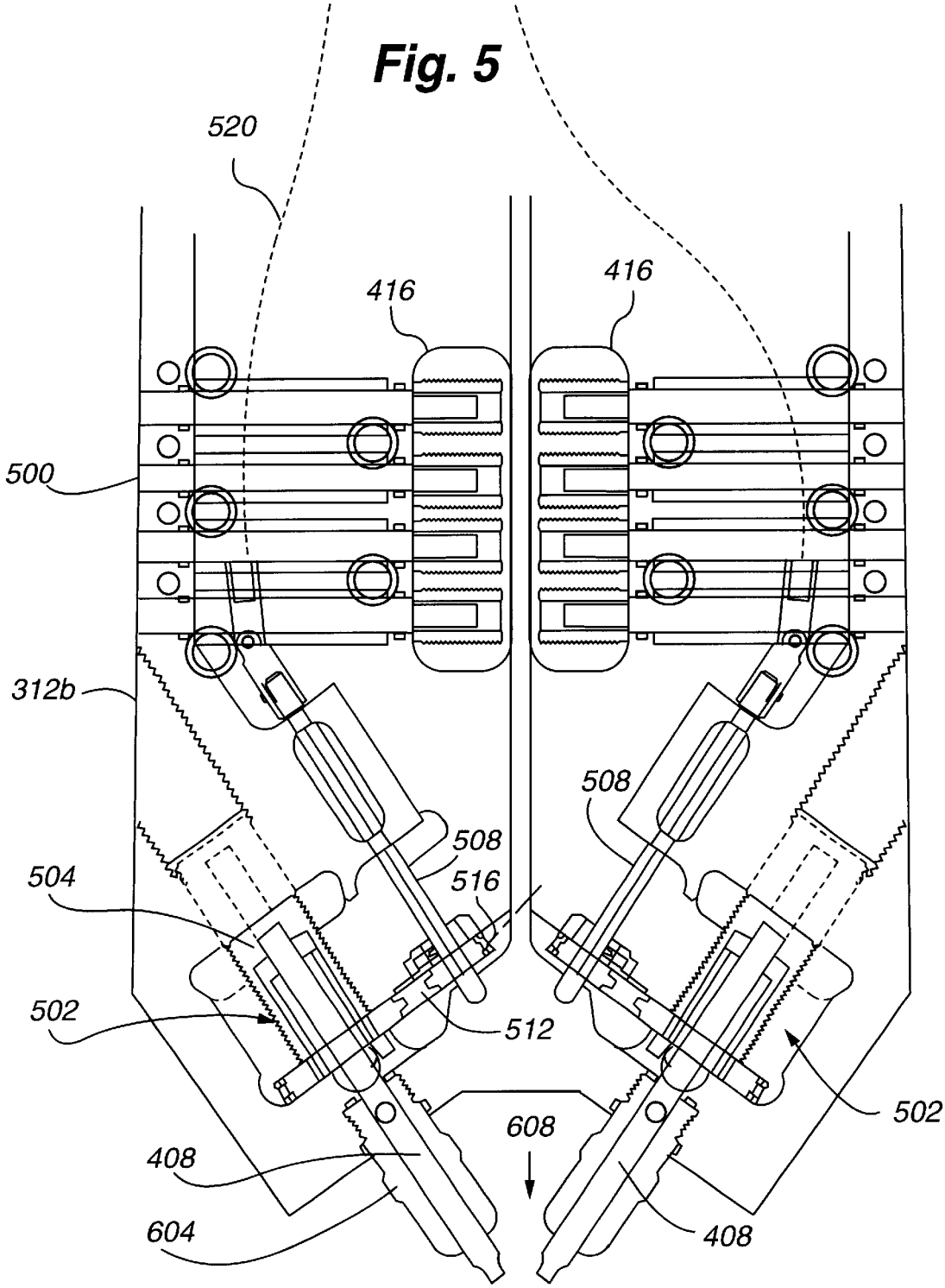
FIG. 5 is a perspective view of a high voltage connection box of a projector, with the cover removed, in accordance with another embodiment of the present invention.

With reference now to FIG. 5, a connection box 312*b* of a projector 304 in accordance with another embodiment of the present invention is illustrated. In general, the connection box 312*b* provides an enclosed space capable of housing interconnections between power cables 328 and both electrodes of a projector 304. A socket block 416 is provided with power cable sockets 500 for making the interconnections between the power cables 328 and the electrodes 408. In the embodiment of the connection box 312*b* illustrated in FIG. 5, both electrodes are identified as electrode 408, to indicate that a floating electrode potential may be used. Alternatively, a hot electrode 408 may be used in connection with a ground electrode 428.

FIG. 5 also illustrates a motorized electrode adjustment mechanism 502 that may be provided for each electrode 408 and/or 428 in accordance with an embodiment of the present invention. The electrode adjustment mechanism 502 generally includes an electrode attachment block and adjustment gear 504 interconnected to an electrode adjustment drive shaft 508 by a drive belt 512 and a secondary adjustment gear 516. The drive shaft 508 may be rotated by a flexible drive cable 520 powered by, for example, an adjustment motor (not shown). The adjustment mechanism 500 allows the electrode 408 to be rotated and to be moved towards the gap 608 to compensate for wear.

Figure 6:
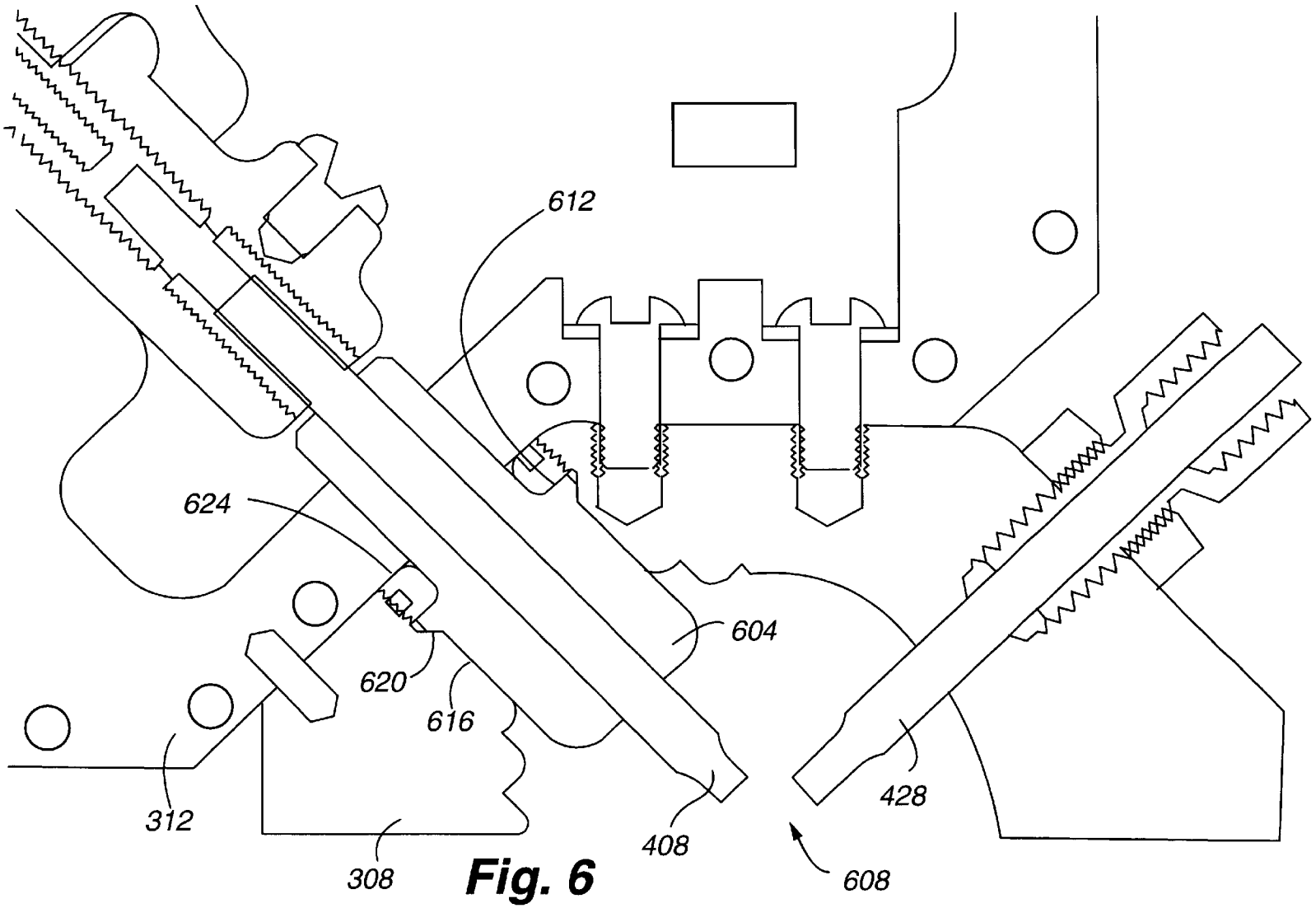
FIG. 6 is a cross sectional view illustrating an electrode insulator in accordance with an embodiment of the present invention.

With reference now to FIG. 6, an electrode insulator 604 in accordance with an embodiment of the present invention is illustrated. As shown in FIG. 6, the electrode insulator 604 isolates the first electrode 408 from the reflector 308 and the connection box 312. In particular, the insulator 604 provides electrical insulation between the first electrode 408 and the reflector 308, to prevent shorting of the gap 608 between the first electrode 408 and the second electrode 428. Accordingly, when the voltage differential between the first 408 and second 428 electrodes exceeds the breakdown voltage of the medium (e.g. the liquid 108) a spark is formed across the gap 608. The electrode insulator 604 may be formed from a resilient dielectric material. Alternatively, the electrode insulator 604 may be formed from a rigid dielectric material.

The electrode insulator 604 features a flange 612 extending about the circumference of the electrode insulator 604. The flange 612 allows the insulator 604 to be interconnected to the reflector 308 in compression. In particular, the insulator 604 is received by a bore 616 formed in the reflector 308 and having a diameter about equal to the diameter of the exterior of the insulator 604. A face of the flange 612 is seated in or rests against a recess or shoulder 620 formed at an end of the bore 616. A retainer ring 624 may be placed over the insulator 604 to secure the flange 612 between the shoulder 620 and the retainer ring 624. In the embodiment illustrated in FIG. 6, the retainer ring 624 is threadably interconnected to the reflector 308. The mounting of the insulator 604 as illustrated in FIG. 6 results in only compressive static loads on the insulator. This arrangement provides much greater strength for the insulator 604 and much greater resistance to shock damage than if the insulator 604 were threaded into the reflector 308 or connector box 312, or otherwise installed in tension.

Figure 7:
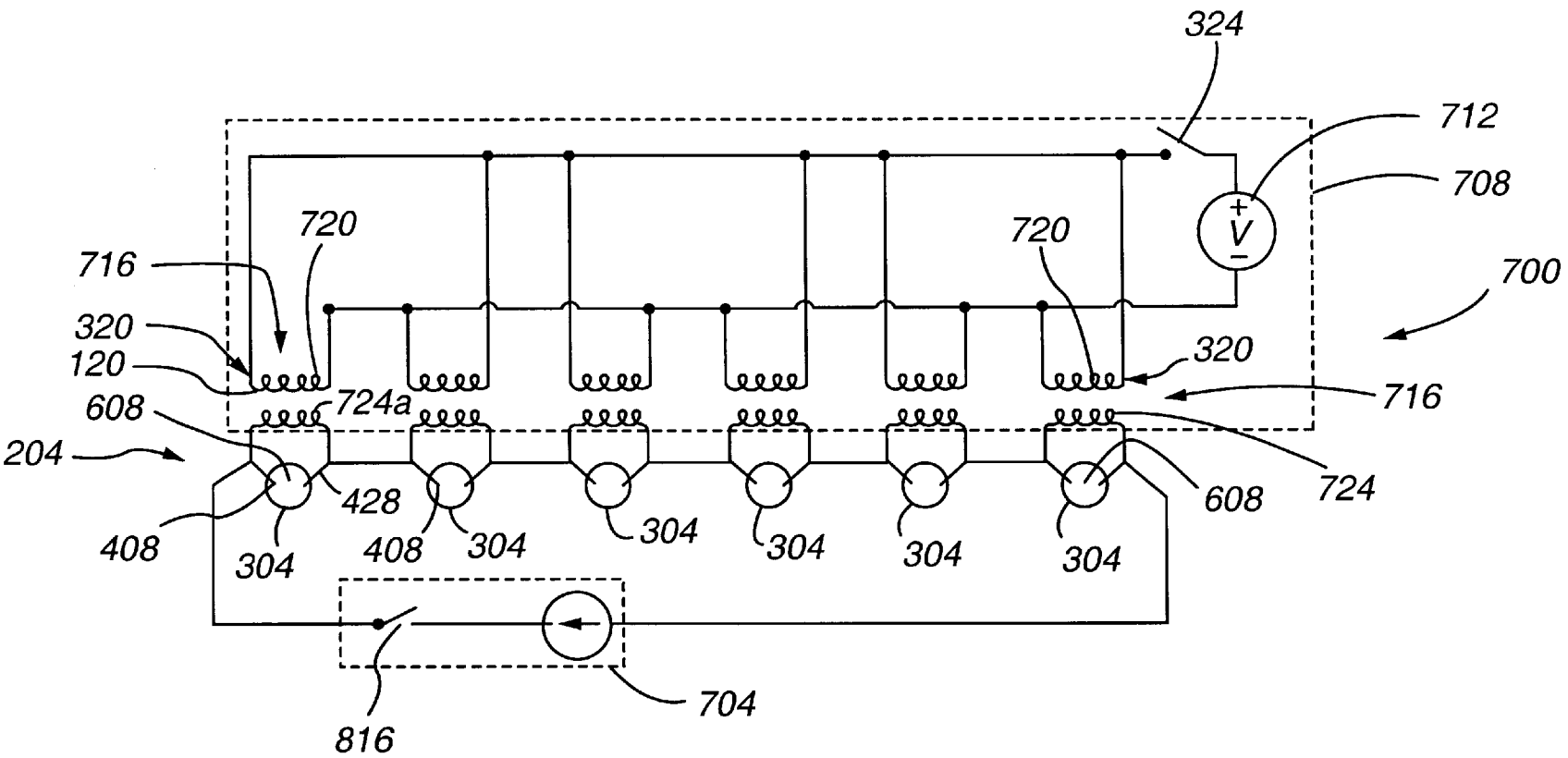
FIG. 7 is a schematic representation of a projector ignition system in accordance with an embodiment of the present invention.

In FIG. 7, a schematic representation of a projector ignition system 700 in accordance with an embodiment of the present invention is illustrated. In FIG. 7, a group 204 of projectors 304, including the electrodes 408, 428 and the gaps 608 between the electrodes 408, 428 are depicted. The electrodes 408, 428 are electrically connected to a current source circuit 704 and a trigger voltage source circuit 708. In general, the current source circuit 704 supplies current to the projector gaps 608 while the trigger voltage source circuit 708 provides the high voltage necessary to allow for the conduction of electrical current across the projector gaps 608.

The trigger voltage source circuit 708 generally comprises a voltage source 712 interconnected in parallel to a plurality of voltage transformers 716 through a trigger circuit switch 324. A trigger circuit voltage transformer 320 is provided for each projector 304 interconnected to the projector ignition system 700. The primary windings 720 of the voltage transformers 320 are interconnected to the voltage source 712 in parallel to allow for the voltage provided by the voltage source 712 to be imposed across each of the primary windings 720. Thus, when the trigger circuit switch 324 is closed, each of the voltage transformers 320 is supplied with the same voltage from the voltage source 712.

With continued reference to FIG. 7, it can be appreciated that the polarities of the transformers 716 are alternated. This arrangement allows the secondary windings 724 of the transformers 716 to provide a voltage across the gaps 608, even though the electrodes 408, 428 of adjacent projectors 304 are tied together. Furthermore, this arrangement provides for a cumulative voltage across all of the gaps 608 equal to zero where there are an even number of projectors 304, or of a single gap 608 where there are an odd number of projectors. Because the projectors 304 are wired in series, current may be supplied to the group of projectors 204 from a single current source circuit 704 in series with the projector 304.

Figure 8:
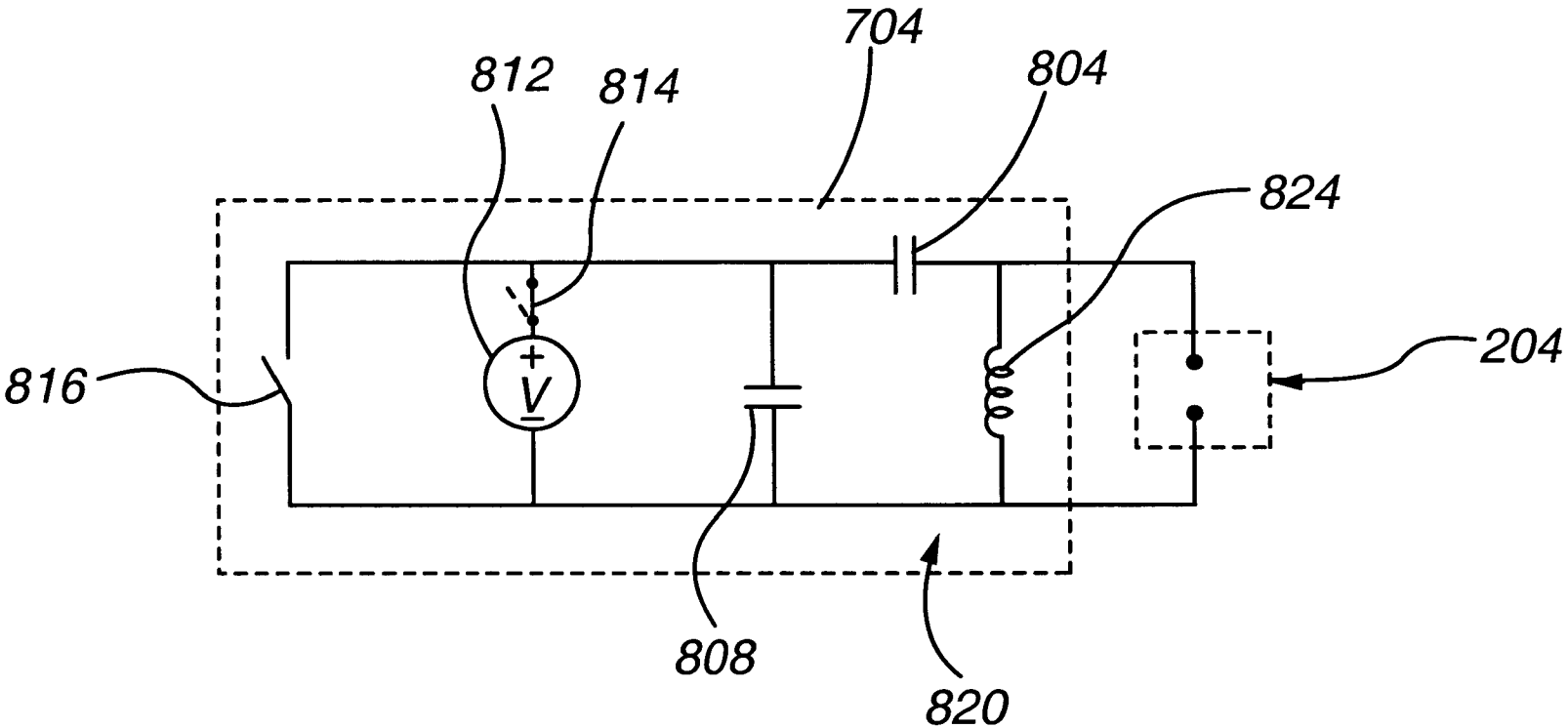
FIG. 8 is a schematic representation of a current source circuit in accordance with an embodiment of the present invention.

With reference now to FIG. 8, a current source circuit 704 in accordance with an embodiment of the present invention is depicted. In FIG. 8, the current source circuit 704 comprises a vector inversion circuit. In a vector inversion circuit, the main supply capacitors 320 comprise first 804 and second 808 capacitors that are charged by a voltage source 812. The first capacitor 804 is in series with the group of projectors 204 while the second capacitor 808 is in parallel with the group of projectors 204. A resonant circuit 820 comprises an inductor 824 and the capacitors 808, 812. The inductor 824 is in parallel with the group of projectors 204.

When firing of the circuit is desired, the voltage source 812 is disconnected from the circuit 704, for example by opening voltage source switch 814, and a control switch 816 is closed. When the control switch 816 is closed, the polarity of the second supply capacitor 808 is inverted due to the LC ringing in the resonant circuit 820. When the second source capacitor 808 is inverted, its voltage is added to that of the first source capacitor 804, effectively doubling the voltage provided across the gaps of the group of projectors 204 connected to the current source circuit 704. When the gaps 608 of the projectors 304 in the group of projectors 204 fire (i.e. when the gaps 608 become electrically conductive), the current in the current source circuit 704 flows through the source capacitors 804, 808, bypassing the control switch 816. Accordingly, the current handling and switching time requirements of the control switch 816 are reduced. In accordance with an embodiment of the present invention, the current control switch 816 comprises a thyratron switch.

With continued reference to FIG. 7, the gaps 608 of the projectors 304 in the group of projectors 204 interconnected to the ignition system 700 are fired by coordinating the operation of the current source circuit 704 and the trigger voltage circuit 708. In particular, the closing of the source current control switch 816 and the closing of the trigger voltage switch 324 are coordinated such that the voltage across the gaps 608 provided by the trigger voltage circuit 708 is at or near a maximum at the time that the current supplied to the gaps 608 by the current source circuit 704 is at or near a maximum. In particular, the trigger voltage circuit 708 is activated to create a conductive channel or streamer across the gaps 608 at about the same time a maximum or near maximum current is supplied by the current source circuit 704, causing ignition of the gaps 608.

As can be appreciated, the trigger voltage source circuit 708 is an efficient supplier of high voltages to the projectors 304 because the primary windings 720 of the transformers 716 are interconnected to the voltage source 712 in parallel. Furthermore, it can be appreciated that the current source circuit 704 efficiently supplies current to the projectors 304 because that circuit 704 is interconnected to the projectors 304 in series. Therefore, the necessary high voltage and high current for igniting the gaps 608 of a group of projectors 204 and creating shock waves of sufficient strength to break rock are provided. Furthermore, the ignition system 700 of the present invention facilitates the provision of a plasma-hydraulic excavation system 200 by providing for the ignition of projectors 304 in such a way that allows continuous operation of the excavation system 200.

Figure 9:
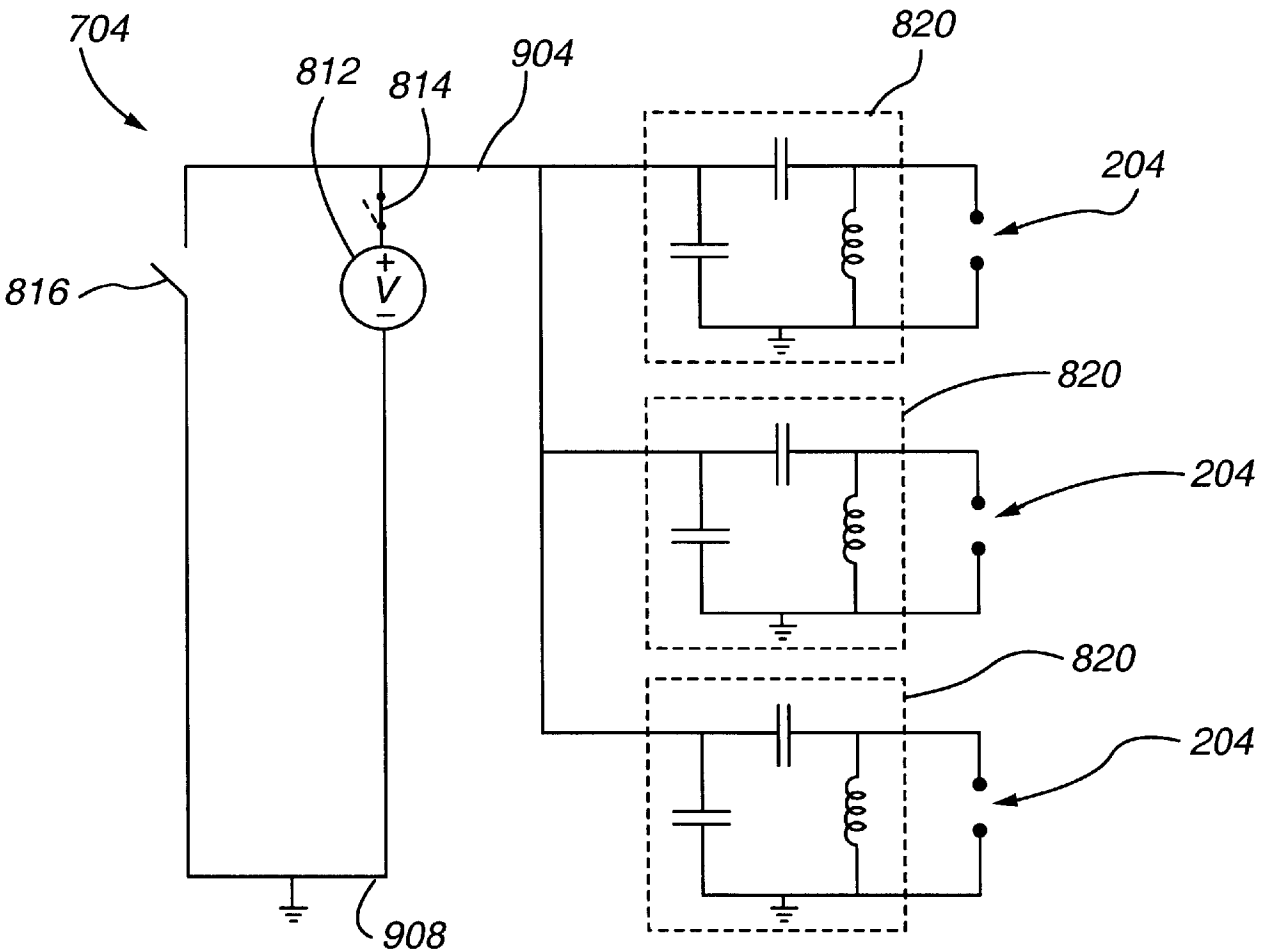
FIG. 9 is a schematic representation of a current source circuit in accordance with another embodiment of the present invention.

With reference now to FIG. 9, a current source circuit 704 in accordance with another embodiment of the present invention is illustrated. In the embodiment of FIG. 9, the current source circuit 704 includes a single control switch 816, a single voltage source switch 814, and a single voltage source 812. However, the current source circuit 704 of FIG. 9 includes three separate resonant circuits 820 interconnected to the voltage source 812 and the control switch 816 in parallel. This configuration allows a single control switch 816 to operate several different groups 204 of projectors 304 comprising an array of projectors. Furthermore, it allows a single pair of cables 904, 908 to be used in connection with the control of the different groups of projectors 204. Accordingly, the voltage source 812 and the control switch 816 can be placed in a remote location, such as in the control module 228, while the capacitors 804, 808 and the inductors 824 of the resonant circuits 820 are located in close proximity to the individual projectors 304. Furthermore, such an arrangement can be utilized in connection with a plurality of plasma-hydraulic excavation modules 208. Accordingly, the number of cables leading to the control switch 816 is reduced, even when an array of projectors 304 made up of a plurality of groups of projectors 204 are utilized in an excavation process.

The forgoing discussion of the invention has been presented for purposes of illustration and description. Further, the description is not intended to limit the invention to the forms disclosed herein. Consequently, variations and modifications commensurate with the above teachings, within the skill and knowledge of the relevant art, are within the scope of the present invention. Embodiments described hereinabove are further intended to explain the best mode presently known of practicing the invention, and to enable others skilled in the art to utilize the invention in such, or in other embodiments, and with various modifications required by their particular application, or use of the invention. It is intended that the appended claims be construed to include alternative embodiments to the extent permitted by the prior art.

What is claimed is:

1. A plasma-hydraulic projector apparatus for breaking rock, comprising:

a first group of projectors, wherein each of said projectors comprises:

at least one reflector;

at least two electrodes, wherein a gap is formed between said at least two electrodes;

a current source circuit, wherein an electrical current is supplied to said first group of projectors in series; and a trigger voltage source circuit, wherein a voltage is applied to said first group of projectors in parallel.

2. The apparatus of claim 1, wherein said first group of projectors further comprises:

a high voltage connection box, wherein an interconnection between a high voltage supply cable and an end of at least a first of said electrodes is established within an interior of said at least a first connection box, and wherein said interior of said connection box is sealed from an exterior environment.

3. The apparatus of claim 1, further comprising:

a frame, wherein said first group of projectors are interconnected to said frame.

4. The apparatus of claim 3, wherein said current source circuit further comprises:

at least a first main supply capacitor, wherein said at least a first main supply capacitor is interconnected to said frame.

5. The apparatus of claim 4, wherein said trigger voltage source circuit further comprises:

a plurality of transformers, wherein said plurality of transformers are interconnected to said frame, and wherein at least a first transformer is provided for each of said projectors.

6. The apparatus of claim 1, further comprising:

a second group of projectors, wherein each of said projectors comprises:

a reflector;

at least two electrodes;

wherein said first and second groups of projectors form an array of projectors, and wherein said array of projectors is ignited by a single current source switch.

7. The apparatus of claim 1, wherein a position of at least one of said electrodes is adjustable.

8. The apparatus of claim 1, wherein a position of at least one of said electrodes is controlled by a motor.

9. The apparatus of claim 1, further comprising:

a mechanism to rotate at least one of said at least two electrodes of each projector, wherein a size of said gap is reduced.

10. The apparatus of claim 1, wherein at least one of said electrodes is formed from a wear resistant material.

11. A method of breaking rock using plasma-hydraulic projectors, comprising:

providing a first plurality of plasma-hydraulic projectors that each comprise a plurality of electrodes forming at least a first gap;

providing a liquid, wherein said liquid occupies at least a portion of said at least a first gap of each of said projectors;

providing a plurality of enclosures, wherein at least a first enclosure is provided for each of said plasma-hydraulic projectors;

interconnecting a high voltage supply cable to an end of an electrode within an interior of each of said enclosures;

providing a high voltage across a gap of each of said projectors using transformers interconnected to a voltage source in parallel;

positioning said projectors adjacent a rock surface; and providing an electrical current to each gap of said projectors from a current source interconnected to said projectors in series to ignite said projectors, wherein a breakdown voltage of said liquid is exceeded, and wherein said rock surface adjacent of said projectors is broken.

12. The method of claim 11, wherein said projectors are ignited at least about 10 times per second.

13. The method of claim 11, further comprising providing a second plurality of plasma-hydraulic projectors, wherein said first plurality of projectors are ignited at a first frequency to provide a first excavation rate, and wherein said second plurality of projectors are ignited at a second frequency to provide a second excavation rate.

14. The method of claim 11, further comprising adjusting a position of at least one of said electrodes to compensate for wear.

15. An ignition circuit for a plasma-hydraulic mining system, comprising:

a plurality of projectors interconnected to one another in series, wherein each of said projectors includes:

at least a first hot electrode;

at least a first ground electrode;

a gap between said at least a first hot electrode and said at least a first ground electrode;

a trigger circuit, including:

a voltage source;

a trigger circuit switch in series with said voltage source;

a plurality of primary windings interconnected to said voltage source in parallel, wherein each of said primary windings comprises a primary winding of a voltage transformer;

a plurality of secondary windings, wherein each of said secondary windings comprises a secondary winding of said voltage transformer, wherein for each of said gaps a one of said secondary windings interconnects said at least a first hot electrode and said at least a first ground electrode, wherein each of said plurality of secondary windings is paired with a one of said primary windings, and wherein a polarity of each of said transformers is alternated so that a potential between interconnected electrodes is zero; and a current source circuit interconnected to said series interconnected projectors.

16. The ignition circuit of claim 15, wherein said current source circuit comprises:

a vector inversion circuit; and a control switch.

17. The ignition circuit of claim 16, wherein said control switch comprises a thyratron.

18. The iginition circuit of claim 16, further comprising a control module, wherein said projectors are ignited at a selected frequency.

19. The ignition circuit of claim 16, further comprising a motor operable to adjust a position of at least one of said hot electrode and said ground electrode.

20. A method of igniting a plurality of plasma-hydraulic projector gaps, comprising:

interconnecting said projector gaps to one another in series;

providing a first voltage potential across said projector gaps from a voltage source circuit; and providing a source of current to said series interconnected projector gaps, wherein a current is conducted across said projector gaps to ignite said projector gaps, whereby a plasma is created in a liquid to create a high pressure shock wave capable of fracturing rock.

21. The method of claim 20, wherein a cumulative voltage across said series interconnected projector gaps introduced by said voltage source circuit is zero.

22. The method of claim 20, wherein a voltage potential between adjacent interconnected projector electrodes not separated by a gap is zero.

23. The method of claim 20, wherein said voltage potential across said projector gaps is at about a maximum voltage at a time that a voltage provided by said source of current is at about a maximum voltage.

24. The method of claim 20, wherein said projector gaps are ignited at a frequency of about 10 Hz.

* * * * *